US010344500B2

(12) United States Patent
Murphy

(10) Patent No.: US 10,344,500 B2
(45) Date of Patent: Jul. 9, 2019

(54) KEY GUARD SYSTEM

(71) Applicant: Aaron Murphy, On (CA)

(72) Inventor: Aaron Murphy, On (CA)

( * ) Notice: Subject to any disclaimer, the term of this patent is extended or adjusted under 35 U.S.C. 154(b) by 0 days.

(21) Appl. No.: 16/143,329

(22) Filed: Sep. 26, 2018

(65) Prior Publication Data

US 2019/0032367 A1 Jan. 31, 2019

Related U.S. Application Data

(63) Continuation-in-part of application No. 15/663,634, filed on Jul. 28, 2017, now abandoned.

(51) Int. Cl.

| | |
|---|---|
| ***E05B 19/00*** | (2006.01) |
| ***E05B 17/20*** | (2006.01) |
| ***G07C 9/00*** | (2006.01) |
| ***E05B 63/00*** | (2006.01) |
| ***E05B 19/04*** | (2006.01) |
| ***A45C 11/32*** | (2006.01) |

(52) U.S. Cl.

CPC ..... *E05B 17/2084* (2013.01); *A45C 11/324* (2013.01); *A45C 11/328* (2013.01); *E05B 19/04* (2013.01); *E05B 63/003* (2013.01); *G07C 9/00309* (2013.01); *G07C 2009/00793* (2013.01)

(58) Field of Classification Search

CPC ..... E05B 19/00; E05B 19/04; E05B 63/003; E05B 13/001; E05B 19/0005; E05B 19/0082; E05B 17/2084; A45C 11/328; A45C 11/324; A44B 15/00; G07C 9/00309; G07C 2009/00793

USPC ..... 70/414, 456 R

See application file for complete search history.

(56) References Cited

U.S. PATENT DOCUMENTS

| | | | | | |
|---|---|---|---|---|---|
| 104,823 | A * | 6/1870 | Brady | E05B 9/045 | 70/397 |
| 1,745,836 | A * | 2/1930 | Miller | E05B 19/00 | 70/388 |
| 1,972,880 | A * | 9/1934 | Flintermann | A45C 11/321 | 362/116 |
| 2,008,398 | A * | 7/1935 | Mangan | A45C 11/328 | 24/3.6 |
| 2,490,396 | A * | 12/1949 | Leff | A45C 11/328 | 70/456 R |
| 2,500,198 | A * | 3/1950 | Mullan | A45C 11/328 | 70/414 |
| 2,514,940 | A * | 7/1950 | Doss | A45C 11/328 | 70/414 |
| 2,547,340 | A * | 4/1951 | Mullan | A45C 11/328 | 70/414 |

(Continued)

*Primary Examiner* — Suzanne L Barrett

(74) *Attorney, Agent, or Firm* — Integrity Patent Group, PLC; Charles E. Runyan

(57) ABSTRACT

A key guard system includes a key cover including a base and a retractable sheath. The retractable sheath includes at least one retracting point, a power source, a wireless connector and a locking mechanism. Further, the key guard system includes a reader having a powered. The key cover and the reader are in wireless communication with each other and further in wireless communication with an application of a mobile device. The key guard system is configured to secure a key within the retractable sheath and prevent tampering and otherwise unwanted removal of the key from the retractable sheath.

20 Claims, 8 Drawing Sheets

(56) References Cited

U.S. PATENT DOCUMENTS 2,547,524 A * 4/1951 Gross ..... A45C 11/328 70/414
2,550,375 A * 4/1951 Pentek ..... A45C 11/328 70/456 R
2,587,037 A * 2/1952 Glubiak ..... E05B 63/003 70/414
2,600,749 A * 6/1952 Gallagher ..... A45C 11/328 70/456 R
2,608,851 A * 9/1952 Leff ..... A45C 11/328 70/456 R
2,625,814 A * 1/1953 Mullan ..... A45C 11/328 70/414
2,699,667 A * 1/1955 Mark ..... A45C 11/328 70/414
2,931,208 A * 4/1960 Prim ..... A45C 11/328 70/414
3,137,157 A * 6/1964 Ralton ..... A45C 11/328 403/106
3,277,680 A * 10/1966 Merila ..... A45C 11/328 279/148
3,313,137 A * 4/1967 Maier ..... A45C 11/328 362/116
3,328,986 A * 7/1967 Ralton ..... A45C 11/328 70/456 R
3,363,440 A * 1/1968 Rivers ..... E05B 19/00 70/414
3,421,349 A * 1/1969 St. Clair, Jr. ..... A45C 11/328 70/414
3,427,834 A * 2/1969 Tutino ..... A45C 11/328 70/414
3,527,072 A * 9/1970 Demetreon ..... E05B 19/00 70/414
3,605,464 A * 9/1971 Ostrager ..... A45C 11/328 70/414
3,672,192 A * 6/1972 Dontas ..... A45C 11/328 70/414
4,628,717 A * 12/1986 Blum ..... A45C 11/321 30/162
4,716,400 A * 12/1987 Kuribayashi ..... A47G 29/10 340/572.1
4,852,374 A * 8/1989 Gotanda ..... H05F 3/02 70/456 R
5,232,086 A * 8/1993 Montanari ..... A45C 11/328 206/37.2
6,216,501 B1 * 4/2001 Marquardt ..... A45C 11/32 70/252
6,886,382 B1 * 5/2005 St. Felix ..... E05B 19/22 70/395
7,290,419 B2 * 11/2007 Balko ..... B60R 25/243 70/408
7,849,721 B2 * 12/2010 Bass ..... A45C 11/321 307/10.3
2006/0016231 A1 * 1/2006 Khounsombath .... A45C 11/324 70/456 R

* cited by examiner

KEY GUARD SYSTEM

CROSS REFERENCE TO RELATED APPLICATION

The present application is a Continuation-in-Part and is related to and claims priority to pending U.S. Non-Provisional patent application Ser. No. 15/663,634 filed Jul. 27, 2017, which is incorporated by reference herein in their entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of key covers and more specifically relates to a key guard system.

2. Description of Related Art

A key is a device that is used to operate a lock (such as to lock or unlock it). A typical key is a small piece of metal consisting of two parts: the blade, which slides into the keyway of the lock and distinguishes between different keys, and the bow, which is left protruding so that torque can be applied by the user. A key is usually intended to operate one specific lock or a small number of locks that are keyed alike, so each lock requires a unique key. The key serves as a security token for access to the locked area; only persons having the correct key can open the lock and gain access. Often times, keys are replicated, and copies may be used to open corresponding locks; sometimes this is undesirable due to security reasons. A suitable solution is desired.

U.S. Pat. No. 2,587,037 to Casper Glubiak relates to a self-ejecting key. The described self-ejecting key includes locking devices and keys used in connection therewith. An object of the invention is to provide a novel and improved locking device and key, in which the key is automatically separated from the locking device whenever the key is turned to a predetermined position in the locking device.

BRIEF SUMMARY OF THE INVENTION

In view of the foregoing disadvantages inherent in the known key cover art, the present disclosure provides a novel key guard system. The general purpose of the present disclosure, which will be described subsequently in greater detail, is to provide a key guard sheath to prevent the unwanted replication of keys.

A key cover is disclosed herein including a base and a retractable sheath. The retractable sheath may include at least one retracting point, a power source, a wireless connector, and a locking mechanism. Further a reader may be provided having a powerer. The wireless connector may be disposed within the key cover and in communication with the reader which may be proximal to a keyhole. The reader and the wireless connector may further be in communication with an application hosted on a mobile device. The locking-mechanism may be configured to selectively lock the retractable sheath and selectively unlock upon receival of a signal from at least one of the reader and the application hosted on the mobile device. Preferably, the base and the retractable sheath are configured to secure the key within the retractable sheath and prevent tampering with and otherwise unwanted removal of the key from the retractable sheath.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a key guard system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a key cover and more particularly to a key guard system as used to improve the security of lending keys and preventing unwanted replication of the keys.

Generally, the present device is a guard or sheath covering a key which prevents the key from being copied so it can be used without authorization. The device includes a locking mechanism which effectively prevents the device from being removed from the key. The locking mechanism may include a spin-lock, fingerprint lock, a lock and key on a base of the device, or other suitable locking mechanisms. The key guard system may include a spring-loaded cover or a folding telescopic cover.

The sheath may be a retractable sheath to allow access to the key. The retractable sheath be may be locked in place until in very close proximity to a reader which may be a separate piece that works with the retractable sheath and allows it to be retracted. The reader may be moved to any locking mechanism, so the retractable sheath can be used with multiple keys. Once the key is placed in the base of the retractable sheath, retracting points located in the retractable sheath may be placed over teeth of the key and locked into the base to hold the key in place. This may prevent access to the key while out of the range of the reader and provide security from copying and misuse of the key.

Preferably, the retractable sheath and the reader may include BLUETOOTH® technology (or other suitable equivalent) to allow for connection between the retractable sheath and the reader. The reader may be positioned on an interior of a door. The retractable sheath may then be able to open when in close proximity to the reader via an electronic handshake (being recognized). In another embodiment, an RFID chip may be included in the retractable sheath itself and the reader may read the RFID chip; the reader may be located on the interior of the door. The retractable sheath and the reader may be able to connect to a smartphone device and controlled via the smartphone device. In one embodiment, the retractable sheath may include a small rechargeable battery capable of many hours of use. Further, the reader may be powered by AA or AAA batteries. The reader may be configured to track when the retractable sheath is activated and is able to be turned on and off through the smartphone device. This allows for full control of a time window someone can use the device.

Referring now more specifically to the drawings by numerals of reference, there is shown in FIGS. 1-5, various views of a key guard system 100.

Figure 1:
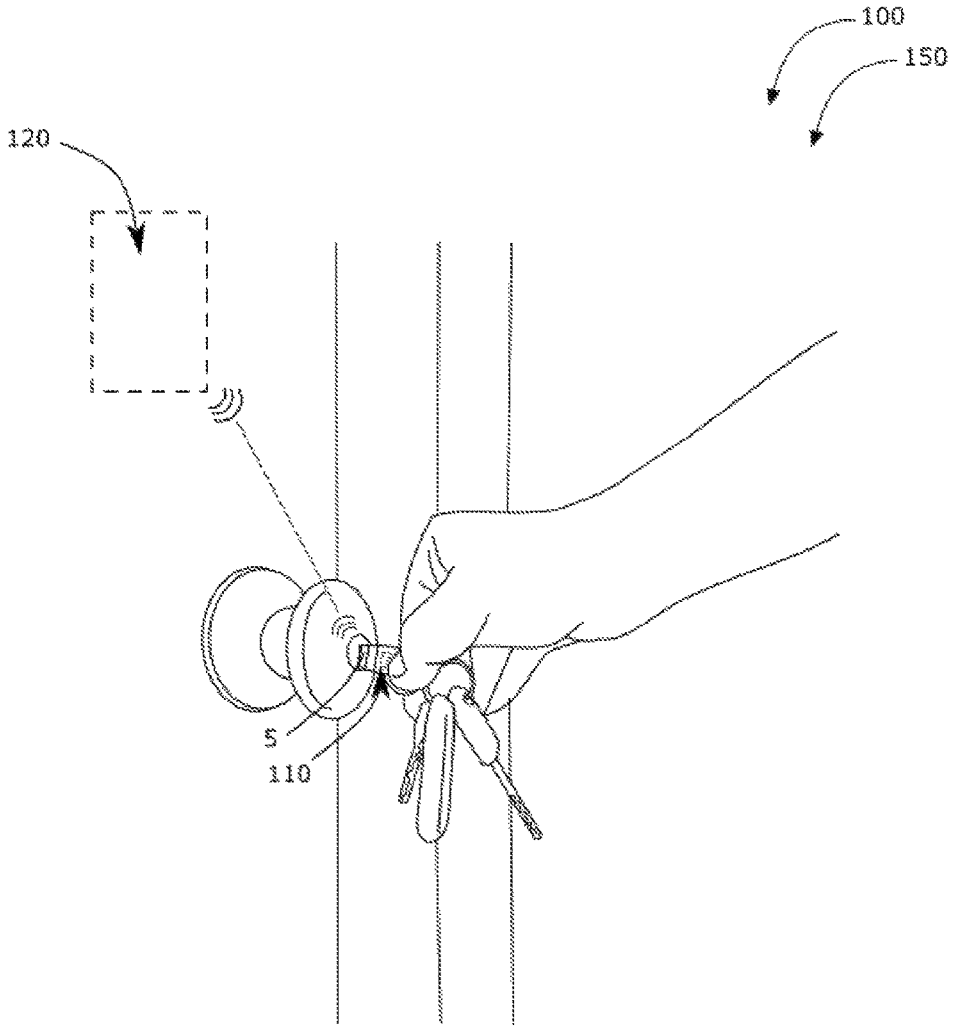
FIG. 1 is a perspective view of the key guard system during an 'in-use' condition, according to an embodiment of the disclosure.
Figure 2A:
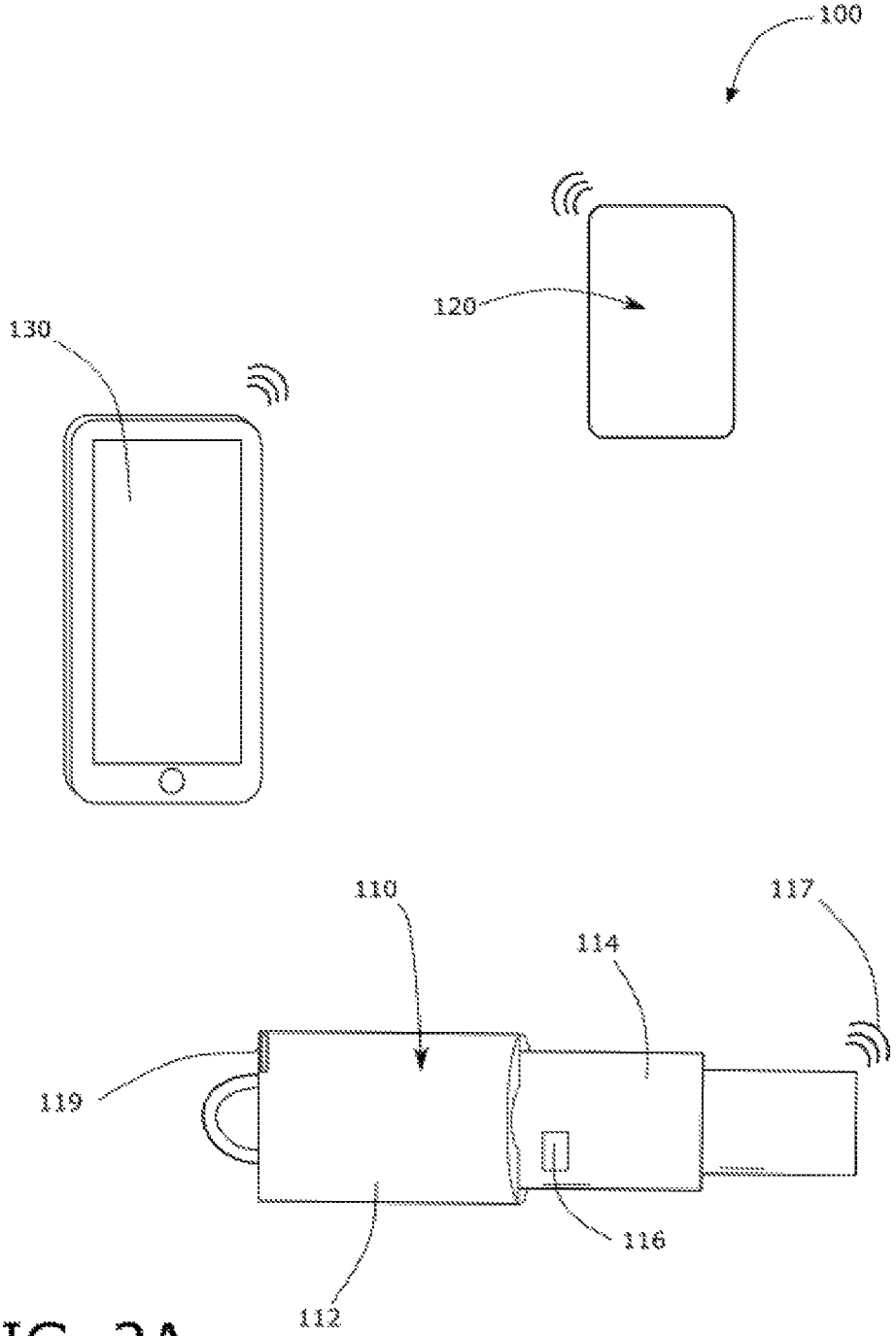
FIG. 2A is a perspective view of the key guard system of FIG. 1, according to an embodiment of the present disclosure.
Figure 2B:
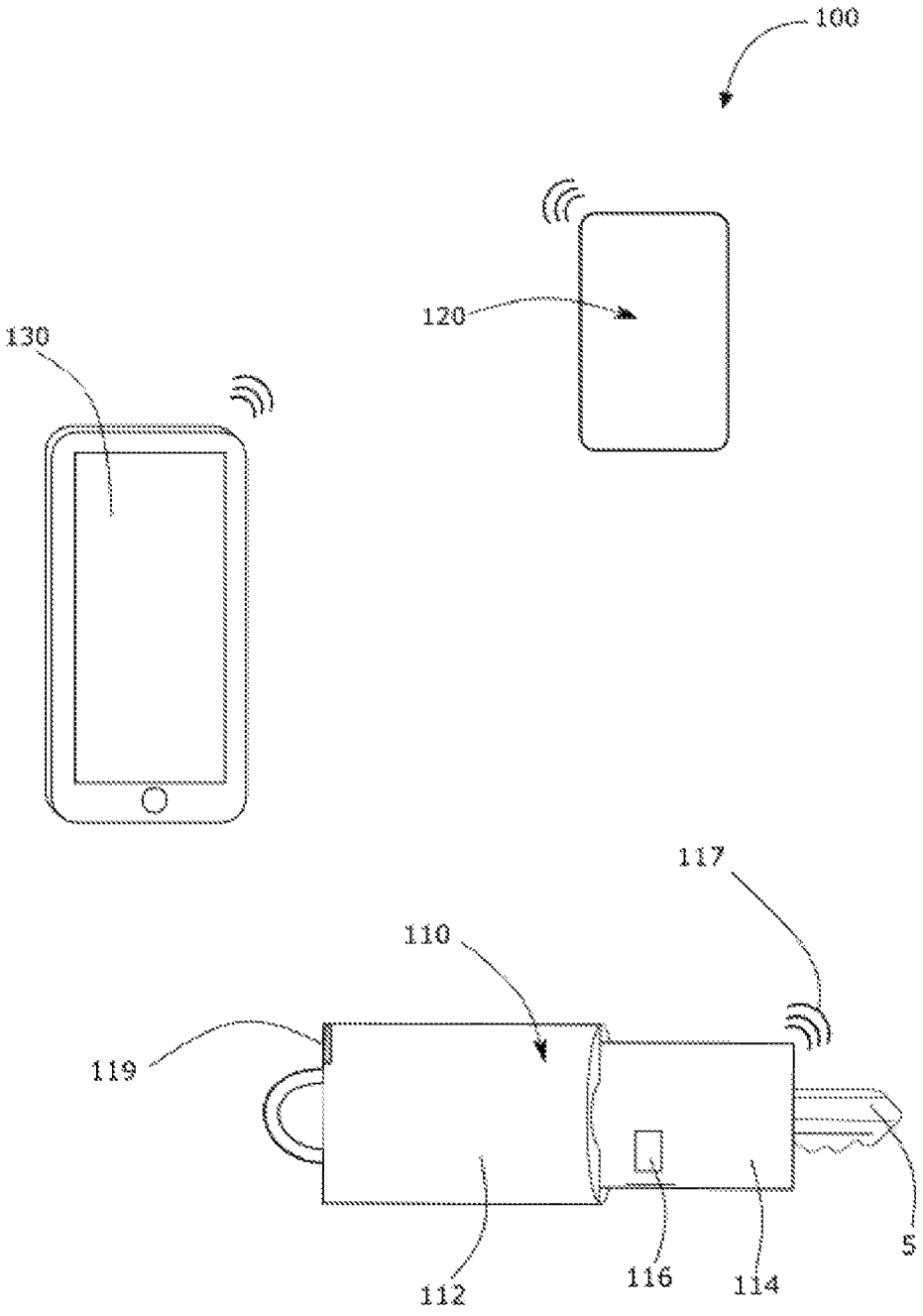
FIG. 2B is a perspective view of the key guard system of FIG. 1, according to an embodiment of the present disclosure.
Figure 2C:
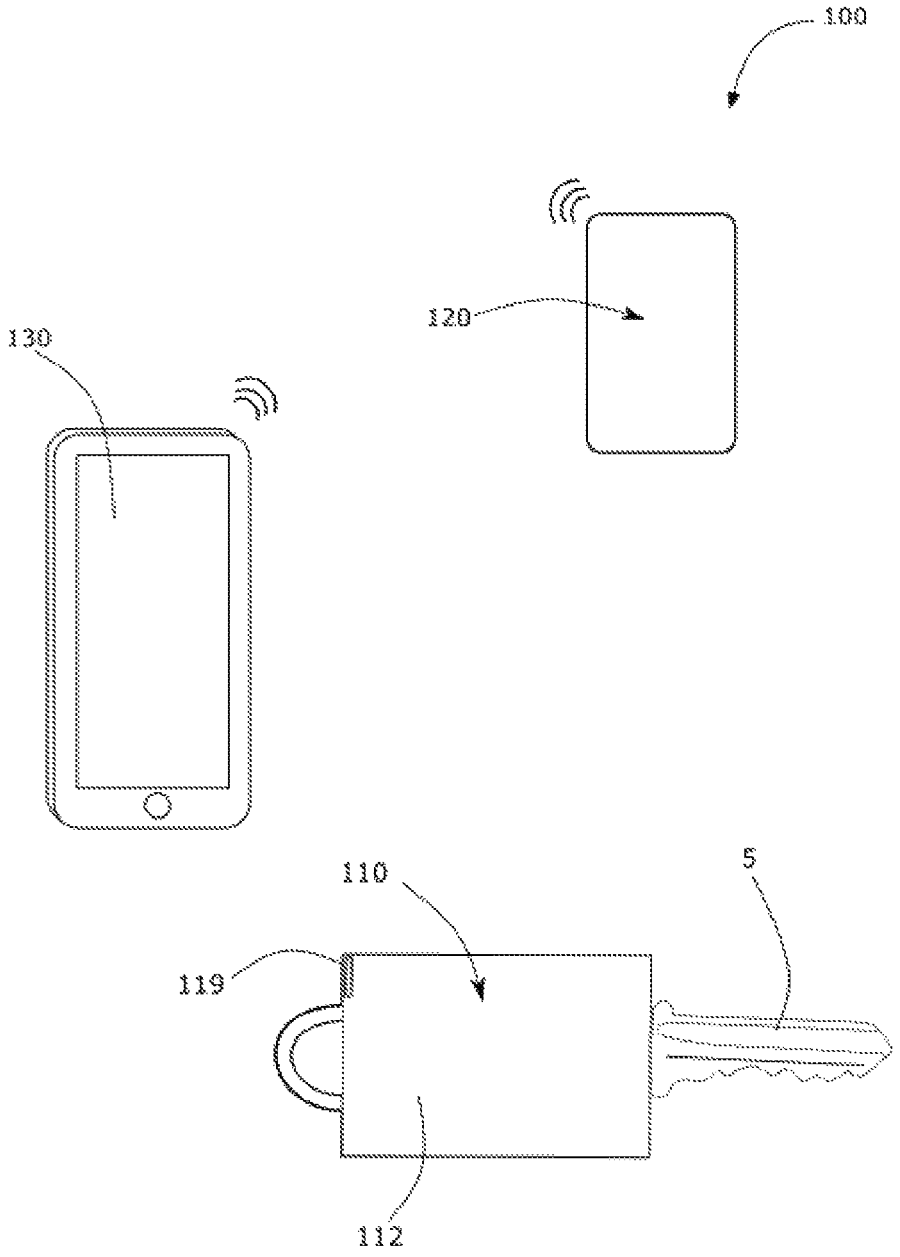
FIG. 2C is a perspective view of the key guard system of FIG. 1, according to an embodiment of the present disclosure.
Figure 2D:
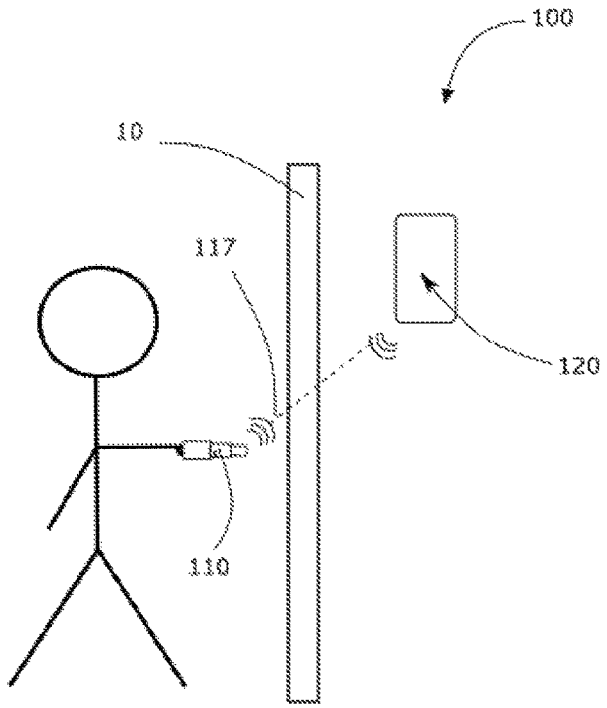
FIG. 2D is a perspective view of the key guard system of FIG. 1, according to an embodiment of the present disclosure.
Figure 2E:
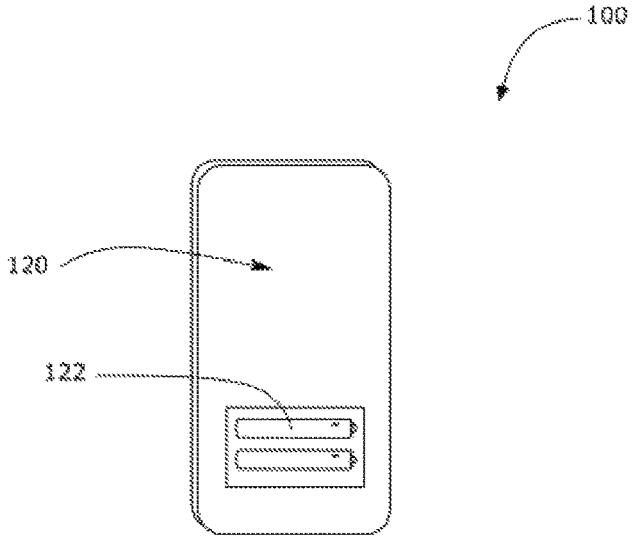
FIG. 2E is a perspective view of the key guard system of FIG. 1, according to an embodiment of the present disclosure.

FIG. 1 shows a key guard system 100 during an 'in-use' condition 150, according to an embodiment of the present disclosure. As illustrated, the key guard system 100 may include a key cover 110 and a reader 120. The key guard system 100 may be configured to secure a key 5 and prevent tampering with and otherwise unwanted removal of the key 5 from the key cover 110.

FIGS. 2A-2E show perspective views of the key guard system 100 of FIG. 1, according to an embodiment of the present disclosure. The key cover 110 may include a base 112 and a retractable sheath 114. In one embodiment, the retractable sheath 114 may include a power source 116 and a wireless connector 117 disposed within the key cover 110 and communicably coupled to the power source 116. Preferably, the wireless connector 117 may be BLUETOOTH®, however other wireless connector 117*s* are also envisioned. The power source 116 disposed within the retractable sheath 114 may include a small rechargeable battery. Examples of small rechargeable batteries contemplated are Nickel Cadmium (NiCd) batteries, Nickel Metal Hydride (NIMH) batteries, Lithium batteries, etc. Further, the power source 116 may include an inlet to allow for the recharging of the small rechargeable battery. In one embodiment, the key cover 110 may include a charging port 119 configured to allow connection of a charging device to quickly recharge the power source 116. The charging port 119 may be located on the base 112 in various areas. As shown in this figure, the charging port 119 may be located at a top of the base 112. However, the placement of the charging port 119 in this figure should not be taken as exact location, and it should be appreciated that the charging port 119 may be located on any area of the key cover 110. Those with ordinary skill in the art will now appreciate that upon reading this specification and by their understanding the art of powering, signals and communications via BLUETOOTH® technology or similar as described herein, methods of electro/mechanical controlling of components via wireless communication and in combination or not in combination with software applications will be understood by those knowledgeable in such art.

Further, the reader 120 may include a powerer 122. The powered may be at least one battery. The at least one battery may be disposable or rechargeable. Preferably, the at least one battery may be an AA or AAA battery. In one embodiment, the reader 120 may be configured proximal to a keyhole. Preferably, the reader 120 may be located on an inside portion of a door 10 such that an outsider is unable to tamper with or view the reader 120.

The wireless connector 117 of the retractable sheath 114 may in communication with the reader 120. In a preferred embodiment, the reader 120 may use short-wavelength UHF radio waves in the ISM band from 2.4 to 2.485 GHz (BLUETOOTH® technology) to communicate with the wireless connector 117 of the retractable sheath 114. The retractable sheath 114 is in communication with the reader 120 and may be configured to retract when in close proximity to the reader 120 so that when the wireless connector 117 of the retractable sheath 114 receives a wireless signal from the reader 120, the wireless connector 117 actuate the retractable sheath 114 to retract, thereby exposing the key and allowing use of the key 5. To prevent unauthorized use of the key 5, the retractable sheath 114 does not retract when out of range from the reader 120. To perform the retraction, the retractable sheath 114 may be spring-loaded for automatic retraction and extension of the retractable sheath 114. In another embodiment, the retractable sheath 114 may comprise a telescopic retractable sheath 114. The telescopic retractable sheath 114 may be spring-loaded or may be manually retracted. Those with ordinary skill in the art will now appreciate that upon reading this specification and by their understanding the art of wireless communication such as BLUETOOTH® as described herein, methods of facilitating such communication to achieve electro/mechanical results/manipulations will be understood by those knowledgeable in such art.

Further, the reader 120 and the wireless connector 117 may be in communication with an application hosted on a mobile device 130. As above, the reader 120, the wireless connector 117 and the mobile device 130 may wirelessly communicate via BLUETOOTH® technology. In one embodiment, the reader 120 may be configured to remotely control the key cover 110 the said mobile device 130. For example, a user may be able to connect to the reader 120 via the mobile device 130 and control actuation of the retractable sheath 114. The user may be able to set timers via the application on the mobile device 130 to allow for a specified period in which the retractable sheath 114 remains retracted, the reader 120 BLUETOOTH® remains active, etc.

Figure 3:
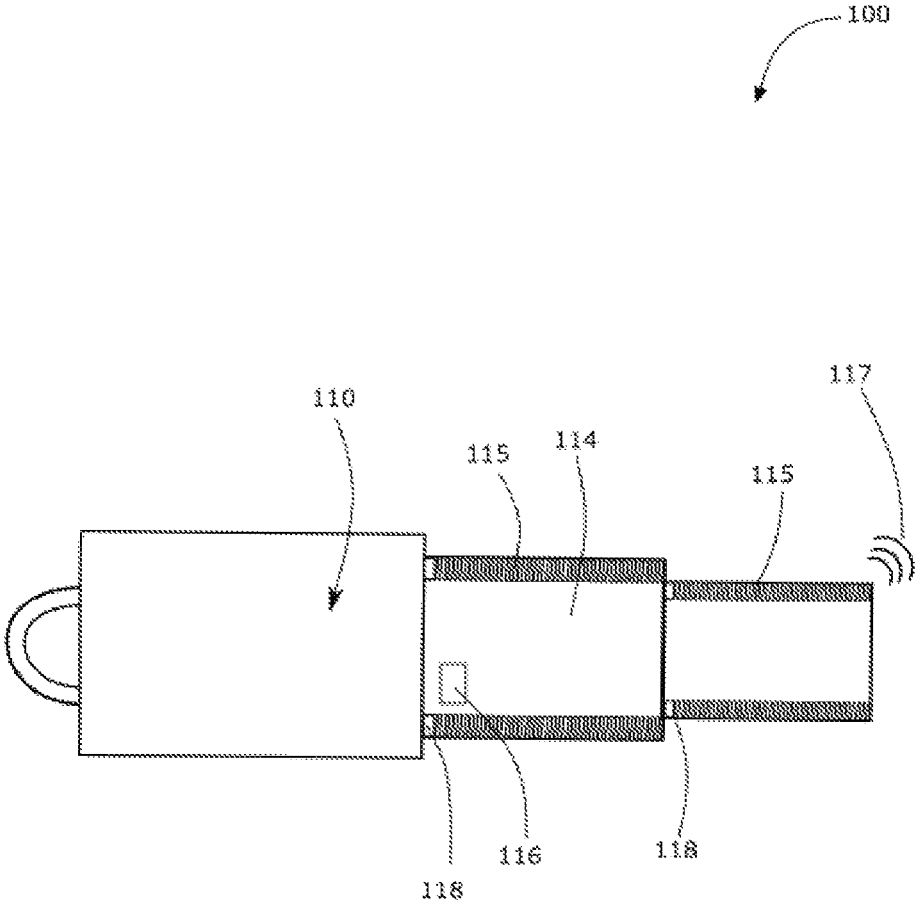
FIG. 3 is a perspective view of the key guard system of FIG. 1, according to an embodiment of the present disclosure.

FIG. 3 shows a perspective view of the key guard system 100 of FIG. 1, according to an embodiment of the present disclosure. In a preferred embodiment, the base 112 and the retractable sheath 114 may be configured to secure the key within the retractable sheath 114 and prevent tampering with and otherwise unwanted removal of said key from said retractable sheath 114. As shown, the retractable sheath 114 may further include at least one retracting point 115 and a locking mechanism 118 configured to selectively lock the retractable sheath 114. In this embodiment the locking mechanism 118 may be configured to unlock upon receival of a signal from either the reader 120 (FIG. 2C) or the mobile device 130 (FIG. 2C) at the wireless connector 117.

The at least one retracting point 115 may comprise two retracting points 115. The two retracting points 115 may be elastic, or spring mechanisms which hold the retractable sheath 114 under spring pressure when the retractable sheath 114 is in an extended position such that when the locking mechanism 118 is locked, or when the wireless connector 117 loses the signal, the retractable sheath 114 is held in the extended position and is highly resistant to manual movement. Thus, a user is unable to manually retract the retractable sheath 114 themselves. In one embodiment, the locking mechanism 118 may override the spring pressure of the two retracting points 115 when actuated. In one embodiment, the locking mechanism 118 may include a latch that is depressed when actuated, such that the two retracting points 115 are able to relax and retract the retractable sheath 114. In another embodiment, the locking mechanism 118 may include a motor powered by the power source 116. The motor may be actuated upon receival of the signal via the wireless connector 117 which may then actuate retraction of the retractable sheath 114. Further, in another embodiment, the locking mechanism 118 may include high pressure elastics configured to hold the retractable sheath 114 in a closed position under spring pressure.

Figure 4:
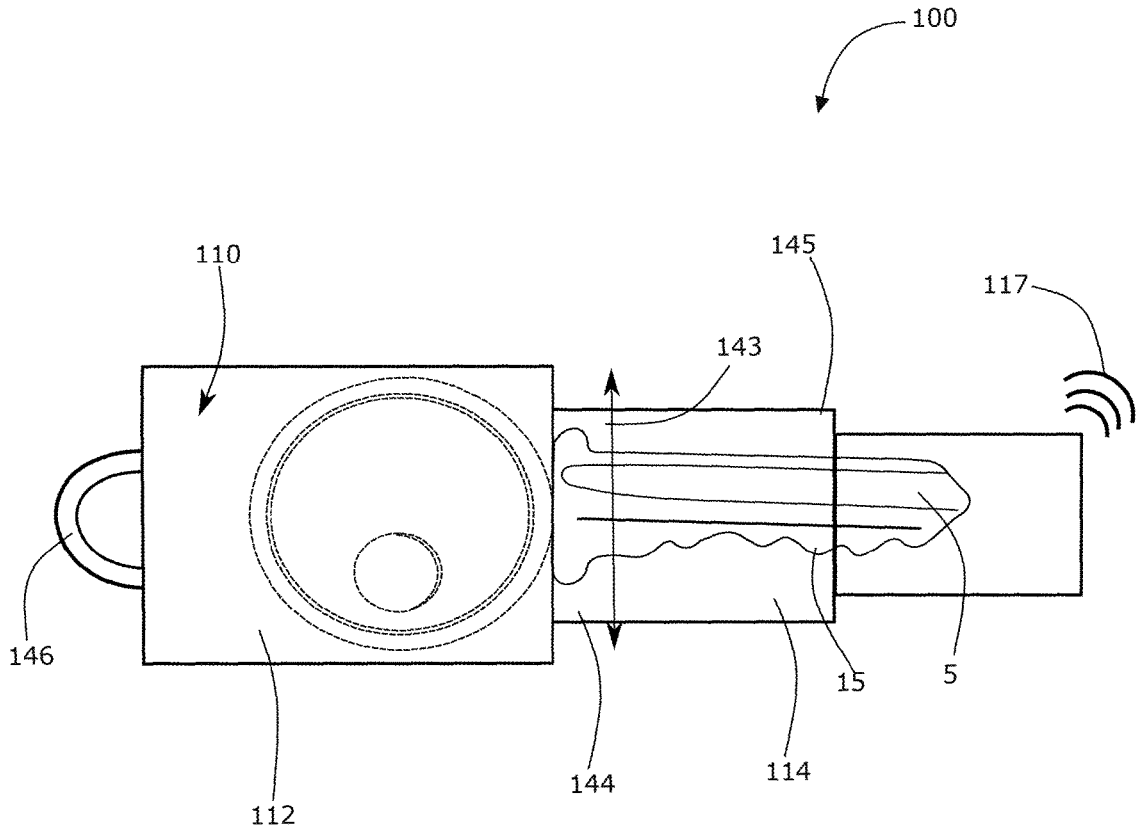
FIG. 4 is a perspective view of the key guard system of FIG. 1, according to an embodiment of the present disclosure.

FIG. 4 shows a perspective view of the key guard system 100 of FIG. 1, according to an embodiment of the present disclosure. The retractable sheath 114 may include a width 143 suitable for receiving the key 5. Further, the base 112 may be connected to a second-end 144 of the retractable sheath 114. In this embodiment, a head of the key is inserted into, and concealed by the base 112. In this embodiment, the base 112 may include an elongated holding piece, such as a screw or pin, to hold the key 5 in place. In this example, the screw or pin may receive an aperture located on the head of the key 5.

The retractable sheath 114 is placed over a body of the key 5 and conceals bitting cuts 15 of the key 5 to prevent use of the key 5 when the retractable sheath 114 is in the extended position. The retractable sheath 114 may be locked onto the base 112 via two adjustable buttons. In this example, the base 112 may include locking apertures, and the retractable sheath 114 may include locking points configured to mate with the locking apertures, such that the retractable sheath 114 is able to lock to the base 114 when the locking points are mated with the locking apertures.

Once the retractable sheath 114 is retracted, the retractable sheath 114 retracts towards the base 112, exposing the bitting cuts 15 of the key 5 via a first-end 145 of the retractable sheath 114. In addition, in one embodiment, the base 112 may further include a clip 146. The clip 146 may be used for fastening to the key guard system 100 to a surface, a key ring, or a user.

Figure 5A:
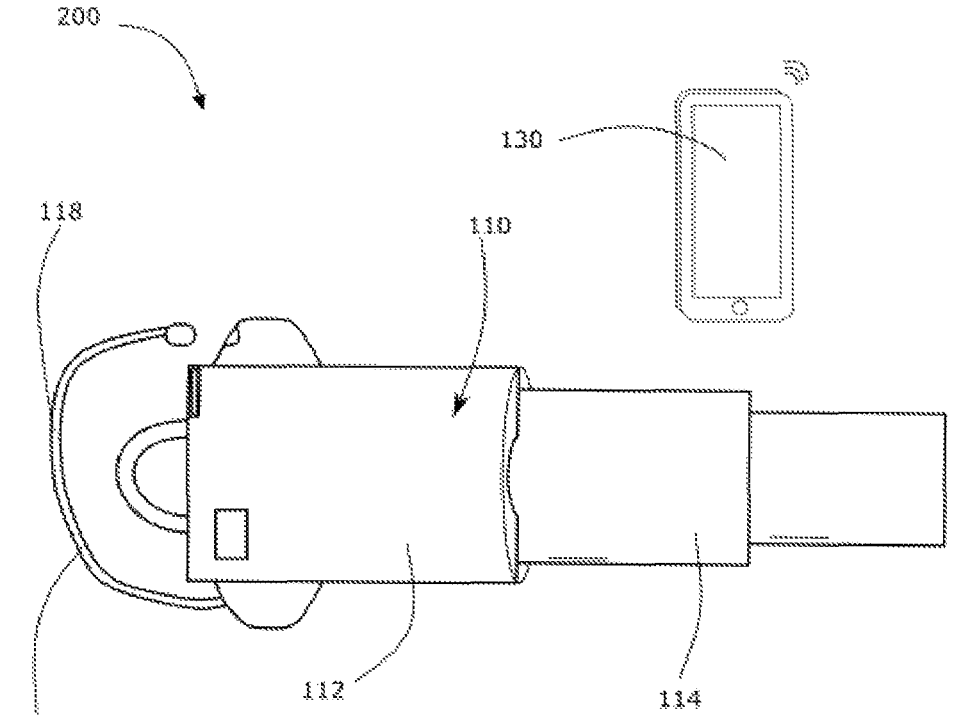
FIG. 5A is a perspective view of the key guard system of FIG. 1, according to an embodiment of the present disclosure.
Figure 5B:
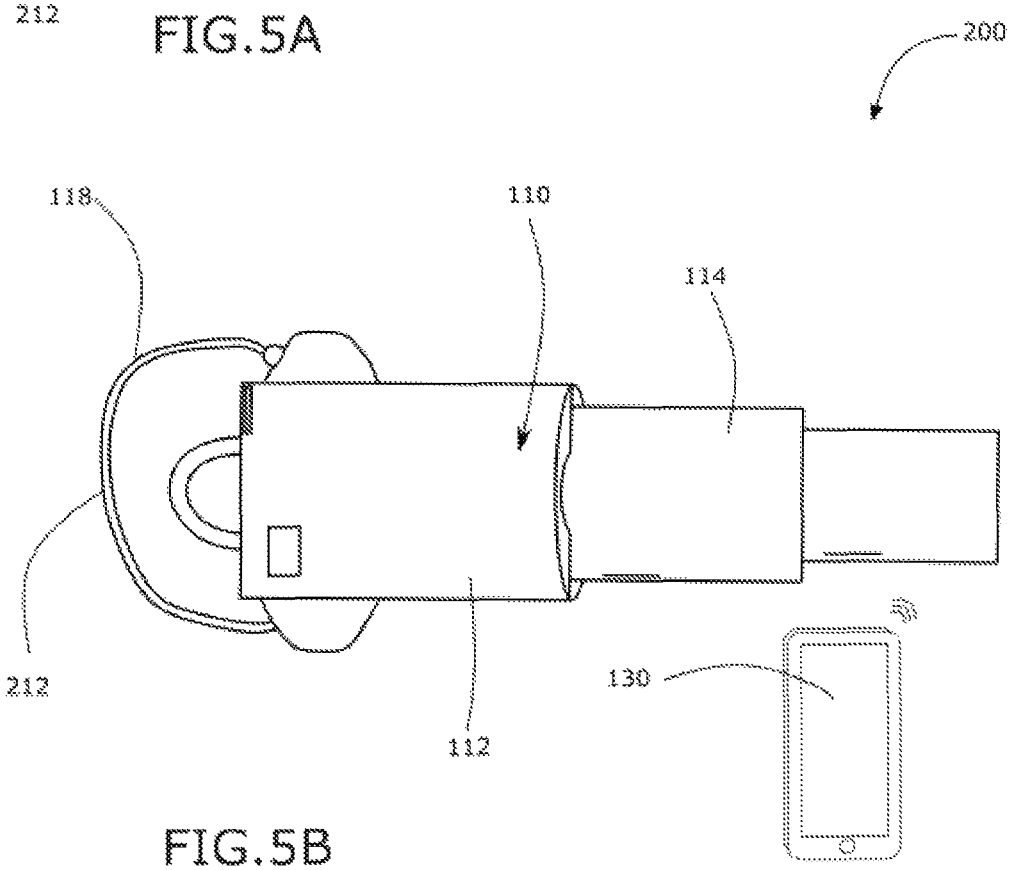
FIG. 5B is a perspective view of the key guard system of FIG. 1, according to an embodiment of the present disclosure.

FIGS. 5A-5B show a perspective views of the key guard system 100 of FIG. 1, according to a different embodiment of the present disclosure. Another embodiment of the key guard system 200 is also disclosed herein. In this embodiment, the key guard system 200 may include the key cover 110 may including the base 112 and the retractable sheath 114. In one embodiment, the retractable sheath 114 may include the power source 116, the wireless connector 117 disposed within the key cover 110 and communicably coupled to the power source 116, the at least one retracting point 115 (FIG. 3) and the locking mechanism 118. In one embodiment, the locking mechanism 118 may be configured to lock the retractable sheath 114 and unlock, causing the retractable sheath 114 to retract, as above. However, as shown, in this alternative embodiment, the locking mechanism 118 may include a retractable cord 212 that is selectively latched onto the retractable sheath 114 and locking key 5 within the retractable sheath 114. Upon receival of the signal, the locking mechanism 118 may be electro-mechanically energized to unlatch the retractable cord 212 from the retractable sheath 114, thus unlocking the retractable sheath 114 and allowing use of the key 5 (FIG. 4). As shown, the retractable cord 212 may be selectively locked into an aperture located on the base 112.

Preferably, the key cover 110 may be made from a weatherproof material such that the key cover 110 is able to be left outside of a building and act as a conventional lockbox. For example, the weatherproof material may be plastic, metal, etc. The retractable cord 212 may allow the key cover 110 to be attached to the outside of the building. The retractable lock is located on the side of the base, as shown. It is very small as it only holds a retractable cord that stretches about 6 inches (or slightly more or slightly less). This feature allows the key cover 110 to be a fully functioning lockbox as well as providing additional security.

As above, the wireless connector 117 may be disposed within the key cover 110 and in communication with an application hosted on the mobile device 130. The wireless connector 117 may use short-wavelength UHF radio waves in the ISM band from 2.4 to 2.485 GHz (BLUETOOTH® technology) configured to communicate with BLUETOOTH® on the mobile device 130. Similar to the key guard system 100 as above, the locking mechanism 118 may be configured to unlock upon receival of a signal from the application hosted on the mobile device 130. For example, in one embodiment, the user may be prompted to enter a code on the mobile device 130. This may then be transmitted via BLUETOOTH® to allow for unlocking of the locking mechanism 118.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

The invention claimed is:

1. A key guard system comprising:

a key cover including;

a base;

a retractable sheath including;

at least one retracting point;

a power source;

a wireless connector;

a locking mechanism;

a reader having;

a powerer;

wherein said wireless connector is disposed within said key cover assembly and in communication with said reader, said reader being configured proximal to a keyhole;

wherein said reader and said wireless connector are further in communication with an application hosted on a mobile device;

wherein the locking-mechanism is configured to selectively lock the retractable sheath;

wherein the locking-mechanism is configured to unlock upon receival of a signal from at least one of the reader and the application hosted on the mobile device;

wherein said base and said retractable sheath are configured to secure said key within said retractable sheath and prevent tampering with and otherwise unwanted removal of said key from said retractable sheath.

2. The key guard system of claim 1, wherein the at least one retracting point comprises two retracting points.

3. The key guard system of claim 1, wherein said reader is located on an inside portion of a door.

4. The key guard system of claim 1, wherein said reader uses short-wavelength UHF radio waves in the ISM band from 2.4 to 2.485 GHz to wirelessly connect to said mobile device.

5. The key guard system of claim 4, wherein said reader is configured to remotely control said key cover assembly via said mobile device.

6. The key guard system of claim 1, wherein said retractable sheath conceals bitting cuts of said key.

7. The key guard system of claim 6, wherein said retractable sheath is in communication with said reader and configured to retract when in close proximity to said reader.

8. The key guard system of claim 7, wherein said retractable sheath does not retract when out of range from said reader.

9. The key guard system of claim 8, wherein said retractable sheath is spring-loaded for automatic retraction and extension of said retractable sheath.

10. The key guard system of claim 1, wherein said retractable sheath includes a width suitable for receiving said key.

11. The key guard system of claim 1, wherein said base is connected to a second-end of said retractable sheath.

12. The key guard system of claim 11, wherein a head of said key is concealed by said base.

13. The key guard system of claim 12, wherein said base further includes a clip.

14. The key guard system of claim 1, wherein said powerer of said reader is at least one battery.

15. The key guard system of claim 1, wherein said power source of said retractable sheath is rechargeable.

16. The key guard system of claim 1, wherein said retractable sheath comprises a telescopic said retractable sheath.

17. A key guard system comprising:

a key cover;

a base;

a retractable sheath including;

at least one retracting point;

a power source;

a wireless connector;

a locking mechanism;

a reader having;

a powerer;

wherein said wireless connector is disposed within said key cover assembly and in communication with said reader, said reader being configured proximal to a keyhole;

wherein said reader and said wireless connector are further in communication with an application hosted on a mobile device;

wherein the locking-mechanism is configured to selectively lock the retractable sheath;

wherein the locking-mechanism is configured to unlock upon receival of a signal from at least one of the reader and the application hosted on the mobile device;

wherein said base and said retractable sheath are configured to secure said key within said retractable sheath and prevent tampering with and otherwise unwanted removal of said key from said retractable sheath;

wherein the at least one retracting point comprises two retracting points;

wherein said reader is located on an inside portion of a door;

wherein said reader uses short-wavelength UHF radio waves in the ISM band from 2.4 to 2.485 GHz to wirelessly connect to said mobile device;

wherein said retractable sheath conceals bitting cuts of said key;

wherein said reader is configured to remotely control said key cover assembly via said mobile device;

wherein said retractable sheath is in communication with said reader and configured to retract when in close proximity to said reader;

wherein said retractable sheath does not retract when out of range from said reader;

wherein said retractable sheath is spring-loaded for automatic retraction and extension of said retractable sheath;

wherein said retractable sheath comprises a width suitable for receiving a blade of said key;

wherein said base is connected to a second-end of said retractable sheath;

wherein a of said key is concealed by said base;

wherein said base further includes a clip;

wherein said powerer of said reader is at least one battery;

wherein said power source of said retractable sheath is rechargeable; and wherein said retractable sheath comprises a telescopic said retractable sheath.

18. A key guard system comprising:

a key cover including;

a base;

a retractable sheath including;

at least one retracting point;

a power source;

a wireless connector;

a locking mechanism;

wherein said wireless connector is disposed within said key cover assembly and in communication with an application hosted on a mobile device;

wherein the locking-mechanism is configured to selectively lock the retractable sheath;

wherein the locking-mechanism is configured to unlock upon receival of a signal from the application hosted on the mobile device;

wherein said base and said retractable sheath are configured to secure said key within said retractable sheath and prevent tampering with and otherwise unwanted removal of said key from said retractable sheath.

19. The key guard system of claim 1, wherein said wireless connector uses short-wavelength UHF radio waves in the ISM band from 2.4 to 2.485 GHz.

20. The key guard system of claim 1, wherein said locking mechanism includes a retractable cord.

* * * * *